US005494228A

United States Patent [19]

Eaton et al.

[11] Patent Number: 5,494,228

[45] Date of Patent: Feb. 27, 1996

[54] MULTIPLE ADHESIVE FOAM BEAD APPLICATOR

[75] Inventors: Robert Eaton, Minooka; Ross Wilson, Utica, both of Ill.; Donald Partyka, Heath, Ohio

[73] Assignee: Insta-Foam Products, Joliet, Ill.

[21] Appl. No.: 439,965

[22] Filed: May 12, 1995

Related U.S. Application Data

[62] Division of Ser. No. 112,650, Aug. 26, 1993, Pat. No. 5,441,583.

[51] Int. Cl.[6] ..... B05B 3/18

[52] U.S. Cl. ..... 239/754; 239/273; 239/302; 239/562; 239/565; 118/315

[58] Field of Search ..... 239/754, 273, 239/280, 285, 302, 525, 562, 565; 118/323, 315, 313, 305, 300, DIG. 2; D23/226, 200

[56] References Cited

U.S. PATENT DOCUMENTS

| | | | |
|---|---|---|---|
| D. 277,499 | 2/1985 | Slager | 239/754 X |
| 3,804,696 | 4/1974 | Lobmeier | 118/305 X |
| 4,011,994 | 3/1977 | Lenz | 239/754 |
| 5,254,167 | 10/1993 | Janoski et al. | 118/315 X |
| 5,366,309 | 11/1994 | Springall | 118/305 X |

FOREIGN PATENT DOCUMENTS

| | | | |
|---|---|---|---|
| 3102132 | 8/1982 | Germany | 118/315 |
| 247391 | 7/1987 | Germany | 118/315 |
| 5309307 | 11/1993 | Japan | 118/323 |
| 513711 | 10/1939 | United Kingdom | 239/754 |

*Primary Examiner*—William A. Cuchlinski, Jr.
*Assistant Examiner*—Lesley D. Morris
*Attorney, Agent, or Firm*—Lockwood Alex FitzGibbon & Cummings

[57] ABSTRACT

A multiple adhesive bead applicator has a handle member and a cross member. A network of adhesive distribution tubes is attached to the application and extends from the handle member to multiple distribution points in a preselected spacing on the cross member. Such an application is useful in a method for applying a cover member, such as an elastomeric membrane or insulation board, to a roofing substrate by first positioning the membrane adjacent a work area, then dispensing multiple beads of an adhesive onto the substrate in a preselected spacing and in a single pass and contacting the adhesive beads with the cover member.

20 Claims, 2 Drawing Sheets

MULTIPLE ADHESIVE FOAM BEAD APPLICATOR

This application is a divisional application of application Ser. No. 112,650, filed Aug. 26, 1993, now U.S. Pat. No. 5,441,583.

The present invention relates generally to multiple adhesive application devices and a method for applying multiple adhesive beads to a substrate, and, more particularly, to an application apparatus for applying multiple, spaced-apart beads of an adhesive to a substrate in a single pass. It also particularly relates to a method for adhering covering materials, such as insulation boards, to a roof substrate by dispensing multiple, spaced-apart beads of an adhesive in a single pass onto the substrate and applying the covering material thereto to seal the substrate. The present invention finds particular utility in the fields of installation of roofing and replacement of roofing.

A typical roof construction includes a lower base or support member, such as corrugated steel decking, and one or more intermediate layers of insulation which cover the base member. These intermediate layers are finished with a waterproof layer which may include roofing felt embedded in hot tar or asphalt to form a substantially water-impervious coating or may include an elastomeric membrane. The intermediate layers may be attached to the roof support member by fasteners or by adhesive means. The finish layer may also be attached to the intermediate layers in a similar manner.

Because of the typically large size of roofs in square footage, the finish and intermediate layers can only be applied to the roof in an area large enough to be completed during the workday. Where an adhesive is used to attach these layers to the roof, a first bead of the adhesive having a preselected width is applied to the roof substrate. An edge of a covering member, such as a rigid insulation board is carefully embedded into the first adhesive layer, and a second bead of adhesive is subsequently applied to the roof at the preselected distance from the first adhesive bead. The roof covering member is then attached to the second adhesive bead and the process is repeated for subsequent adhesive beads. Because adhesives have a limited curing time, after which time they lose their adhesive properties, only a few adhesive layers may be laid at a time.

The present invention is directed to an apparatus which overcomes the above-mentioned disadvantages and accordingly concerns itself with a low cost, hand-held multiple adhesive bead applicator which dispenses multiple beads of adhesive in a predetermined spacing to a substrate in a single pass, thereby reducing the amount of time required to apply adhesives in roofing installation and reconstruction.

This is accomplished by providing a rake-like apparatus having a handle member joined to a base member. An adhesive-conveying network of multiple flexible tubes extends along the handle from a handle valve to the base member where it is dispensed through multiple application tubes affixed to the base member. The network of adhesive application tubes includes a primary adhesive distribution tube and at least two secondary adhesive tubes interconnected to a plurality of adhesive application tubes mounted on the base member. The adhesive flows out of the application tubes onto the substrate. The application tubes are positioned at a preselected distance from the roof substrate by means of skids or wheels such that the adhesive of each application tube is applied directly to the roof substrate. In this manner, multiple beads of adhesive may be dispensed onto the roof substrate in a single pass which reduces the time for installation of a roof.

Accordingly, it is an object of the present invention to provide a multiple adhesive bead application apparatus which is of low cost and which is easily operated by a single individual, the apparatus having a network of adhesive distribution passages leading from an inlet disposed on a handle member to a plurality of adhesive application tubes disposed on a cross-member, the adhesive application tubes being disposed in a predetermined spacing along the cross member and spaced apart from a substrate by suitable members such as skids or wheels.

Another object of the present invention is to provide a method for applying one or more covering members, such as rigid insulation boards or a flexible membrane to a roof substrate by applying multiple, spaced-apart adhesive beads to the substrate in a single pass and then contacting the covering members to the multiple adhesive beads, in which a multiple adhesive bead applicator dispenses the adhesive beads from a single pressurized adhesive supply source.

These and other objects of the present invention will become more readily apparent from a reading of the following detailed description taken in conjunction with the accompanying drawings wherein like reference numerals refer to like parts.

BRIEF DESCRIPTION OF THE DRAWINGS

In the course of this description, reference will be made to the attached drawings in which.

DETAILED DESCRIPTION OF THE PRESENT INVENTION

Figure 1:
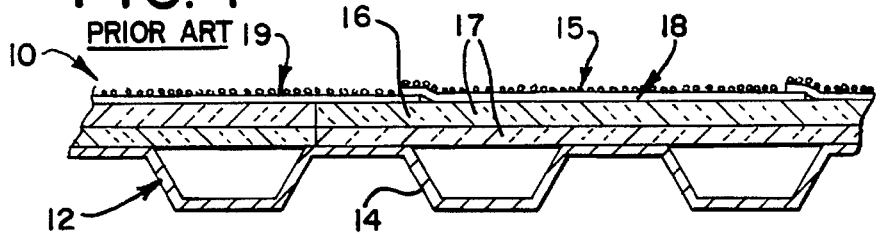
FIG. 1 PRIOR ART
FIG. 1 is a sectional view of one typical roof construction.
Figure 2:
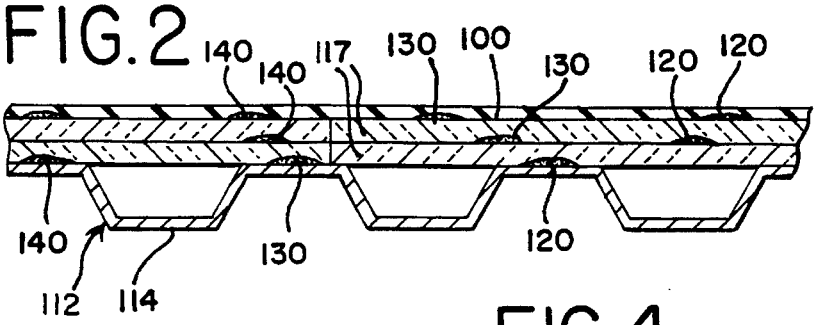
FIG. 2 is a sectional view of another typical roof construction.

FIGS. 1 and 2 illustrate cross-sections of two styles of representative roof construction. The roof 10 has a base or support member 12, shown as a section of corrugated steel decking 14, extending between structural columns and girders of the structure to provide structural support of the roof 10. The roof substrate 16 may include the roof decking 14 and one or more layers of rigid insulation 17 in the form of extruded polystyrene or cork boards. A waterproof top layer 18 formed from either one or more layers of roofing felt 19 embedded in a hot tar or asphalt and having a gravel mixture 15 applied thereto serves as a finish layer. This roof construction is commonly referred to as a "built-up roof". An alternate roof construction as shown in FIG. 2, utilizes a similar support member 112 and similar insulation layers 117 but includes as a finish layer, a flexible, impervious elastomeric membrane 100, adhered to the roof intermediate layers or substrate.

In such roof constructions, the roofing crew adheres the intermediate insulation boards 117 to the decking 114 by applying a first bead 120 of an adherent compound to the decking 114. Second or third beads 130, 140 of the adherent compound are also deposited from a single stream applicator (not shown) to the decking 114. Subsequent to this application of adherent compound, the insulation boards 117 are contacted to the decking 114 and adherent compound beads 120–140. When one layer of insulation board is installed, the process may be repeated to attach a covering layer of insulation board to the same. A flexible, elastomeric membrane 100 may be further adhesively attached to the top most layer of the substrate 116 to provide a finished cover layer.

Adhesives are used to adhere the covering members to the decking or base member 114 as well as adhere the insulation boards to each other. Such adhesives may be single component, moisture-cured adhesive and may have a tack-free time of 30 minutes or less. Accordingly the application of individual, separate beads of adhesive 120, 130, 140 is time-intensive because it requires the roofer depositing the adhesive beads 120 to ensure that they are applied in a predetermined spacing and contacted by the membrane prior to the foam curing.

The present invention eliminates the need for individually depositing such individual adhesive beads and aptly further reduces the labor required for application in that it permits an individual to dispense multiple adhesive beads in a predetermined spacing in a single pass. In accordance with a method of the present invention, the roofer dispenses multiple adhesive beads in a predetermined spacing to the roof substrate and subsequently contacts a cover member to the substrate member.

Figure 3:
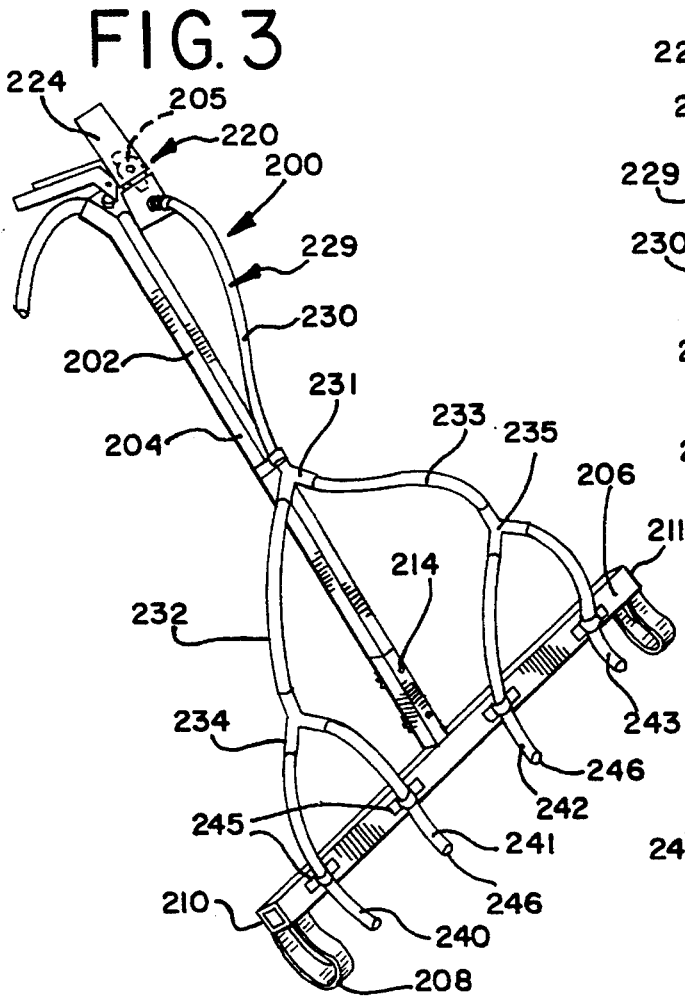
FIG. 3 is a perspective view of a multiple bead adhesive dispensing apparatus in operation.
Figure 4:
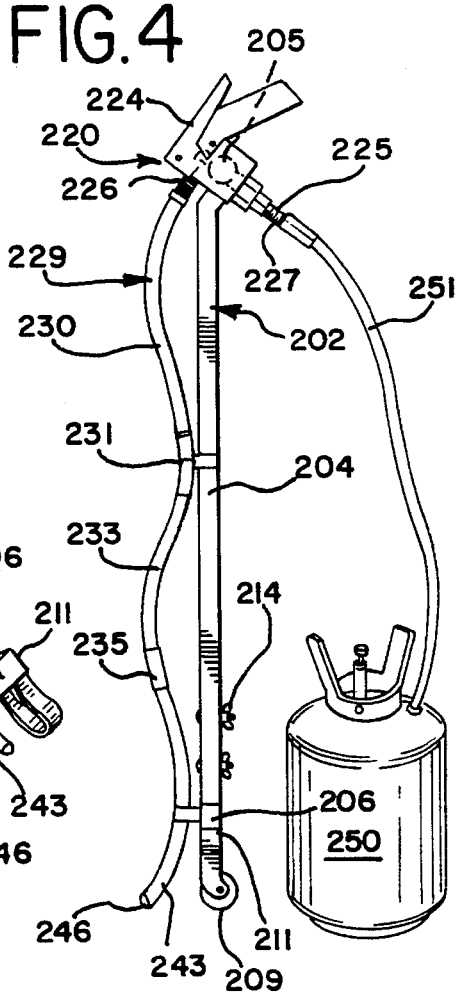
FIG. 4 is an end view of the multiple bead adhesive dispensing apparatus of FIG. 3, but having an alternate positioning means.

Turning to FIGS. 3 and 4, a multiple bead adhesive distribution apparatus 200 particularly suitable for use in a method of the present invention is illustrated. The adhesive distribution apparatus 200 includes a rake-like applicator 202 having a handle member 204 extending down to a base, or cross-member 206. The cross member 206 includes means for positioning the cross-member 206 in relation to the substrate 116, such as a pair of skid portions 208 disposed at opposite ends 210, 211 thereof. Alternately, the cross-member 206 may utilize wheels 209 (FIG. 4) or another suitable mechanism to distance the cross-member 206 from the substrate. The cross member 206 is preferably connected to the handle member 204 by a suitable interconnection means such as nuts and bolts 214, to give the adhesive distribution apparatus 200 a "knock-down" nature, thereby permitting it to be assembled and unassembled in a minimum amount of time at the job site.

An adhesive transfer assembly 220 is mounted near the top of the handle member 204 and may include a valve 205 contained therein which is operable by way of a handle 224. The valve 205 controls the supply of adhesive transmitted through the applicator 202. In this regard, the adhesive transfer assembly 200 includes an inlet 225 and an outlet 226. The inlet 225 includes conventional interconnection fittings 227 which permit quick and easy connection to a supply hose 251 of a portable, pressurized adhesive supply source 250. The outlet 226 communicates with a network of adhesive distribution tubes 229 by way of a specific connection to a primary adhesive distribution tube 230. The primary adhesive distribution tube 230 extends partially down to a wye-type fitting 231 which splits the flowpath of the first distribution tube 230 into two separate and equal flowpaths defined by secondary adhesive distribution tubes 232, 233. These secondary adhesive distribution tubes 232, 233 also engage similar wye-type fittings 234, 235 which again serve to split the secondary flowpaths into third, or dispensing flowpaths defined by adhesive application tubes 240–243, with four such application tubes being illustrated in FIGS. 3 and 4.

These application tubes 240–243 are mounted on the rake cross-member 206 by conventional means, such as adjustable and selectively releasable pipe clips 245, which permit the application tubes 240–243 to be easily adjusted to position the tube outlets 246 of the same in a predetermined spacing away from the roof substrate 116, the distance between the adhesive application tube outlets 246 is further controlled by the operator adjusting the angle of the applicator 202 relative to the roof substrate. The skids 208 or wheels 209 permit the applicator 202 to be slid or pushed by the operator along the roof substrate. The adhesive application tubes 240–243 are spaced apart on the applicator cross-member 202 in a predetermined spacing dictated by the adhesive strength or the desired spacing between adjacent adhesive beads. It has been found that an application tube spacing of approximately one foot gives preferred results.

The secondary adhesive distribution tubes 232, 233 are preferably of the same length so that act as parallel pipes such that the head losses of the adhesive as it travels through the applicator are the same in any of the secondary tubes 232, 233. The same holds true for the individual adhesive application tubes 240–243 which also share a common length and thus the adhesive will exit the application tubes 232, 233 onto the substrate 116 at the same pressure such that all the adhesive beads dispensed are generally equal in density and diameter. Similarly, the diameter of the all of the component tubes which make up the adhesive distribution network 229 are uniform. Preferred results are obtained by using flexible tubes having a diameter of between approximately one-half inch and three-quarters inch. Because the adhesive used in such an applicator 202 is generally non-expanding, the resultant diameter of the applied adhesive bead 120 will be substantially the same as the application tube diameter.

A referred adhesive which gives particularly desirable results is a frothed urethane pre-polymer adhesive, such as the INSTA-STIK™ adhesive manufactured and sold by Insta-foam Products, Inc. of Joliet, Ill. which is a single component moisture-cured adhesive. It is also preferable that such an adhesive be maintained in a pressurized single adhesive supply source 250 in which the adhesive is contained in a pressurized canister. A frothing agent may be included in the canister which froths the adhesive upon exit from the supply source 250 and applicator 202 such that the dispersed adhesive temporarily expands to permit it to maintain a desired thickness or height. Eventually, the adhesive settles. This initial expansion upon application serves to increase the surface contact between the two materials being adhered together.

Figure 5:
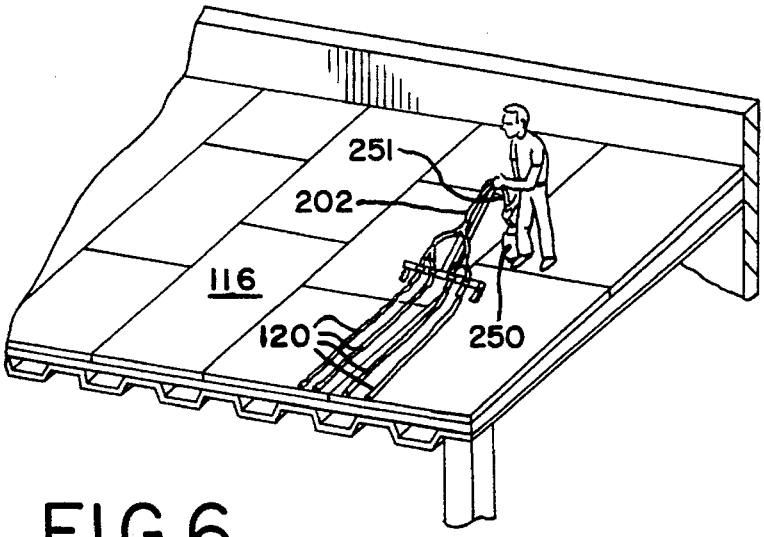
FIG. 5 illustrates a method of adhering a covering member to a roof substrate, and particularly, the step of dispensing multiple, spaced-apart beads of adherent compound from the dispensing apparatus of FIG. 3 onto the roof substrate.
Figure 6:
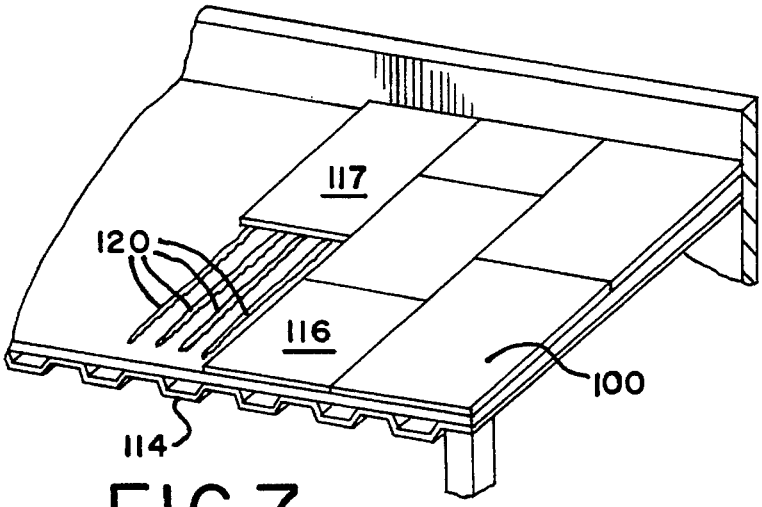
FIG. 6 illustrates the step of contacting a generally rigid insulation board cover member to a roof substrate.
Figure 7:
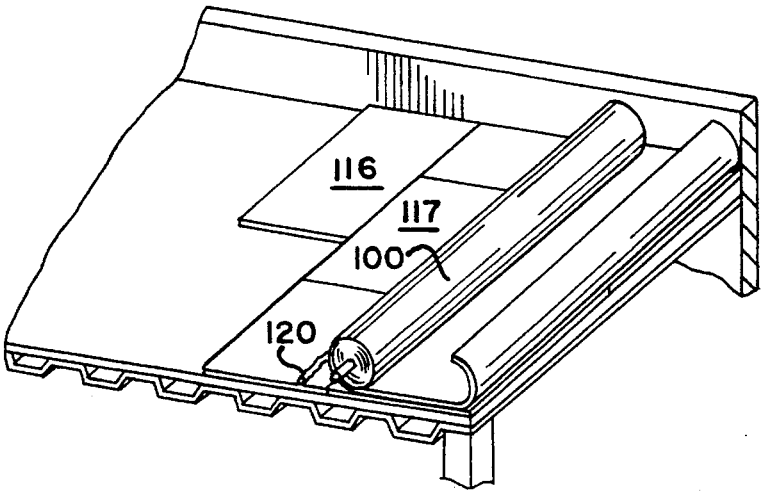
FIG. 7 illustrates an alternate step of contacting a flexible membrane cover member to the multiple beads of adhesive deposited on the roof substrate.

Turning now to FIGS. 5–7, a method of applying a cover member 100, to the roof substrate 116 is illustrated. The cover member may be either insulation boards 117 or a flexible membrane 100. The operator connects the pressurized adhesive supply source 250 to the applicator 202 by connecting the two together with the supply hose 251. In some instances, the adhesive supply source 250 must be agitated, such as by shaking to ensure that any frothing agent utilized to froth the adhesive will appropriately dissolve. After connection to the adhesive supply source 250, the applicator 202 is then positioned adjacent the membrane material supply and the applicator valve 205 is manually operated by the operator by way of applying pressure to the nozzle handle 204. As adhesive begins to dispense out of the application tubes, the applicator 202 is pushed or dragged along a predesignated line to apply multiple adhesive beads 120 (four such beads being shown in the Figures) to the substrate 116. Covering material such as extruded polystyrene or cork boards 117 are then contacted to the adhesive beads 120. In FIG. 7, a membrane 100 is shown as the covering material adhesive beads are dispersed onto the insulation board 117 by way of applicator 202 and the membrane is then rolled onto the adhesive beads 120 and into contact therewith. The adhesive beads 120 may be spaced out after contact with the cover members by exerting pressure onto the cover members above the beads. Another pass is made with the applicator 202 and the cover member contacting step is repeated. Thus, the present invention efficiently permits multiple beads of adhesive to be applied on the substrate in a single pass, thereby substantially reducing the time for installation.

It will be appreciated that the embodiments of the present invention that have been discussed herein are merely illustrative of a few applications of the principles of the invention. Numerous modifications may be made by those skilled in the art without departing from the true spirit and scope of the invention.

What is claimed is:

1. A low cost, hand-held applicator for applying multiple beads of an adhesive to a roofing substrate in a single pass, the applicator comprising:

a handle member interconnected to a base member, the base member extending generally perpendicularly to the handle member, said base member including means for slidingly engaging the roofing substrate and maintaining said base member at a preselected distance from said roofing substrate, said handle member further including an adhesive transfer assembly adapted to selectively permit passage of adhesive from an adhesive supply source therethrough, adhesive bead dispensing means attached to said applicator and extending between said handle member to said base member, said base member further including a plurality of adhesive bead application tubes, the adhesive bead dispensing means providing multiple adhesive passages disposed between said adhesive transfer assembly and said plurality of adhesive application tubes, said adhesive bead dispensing means further including at least a primary adhesive distribution tube extending between said adhesive transfer assembly and said plurality of adhesive application tubes, the primary adhesive distribution tube including at least one wye fitting providing a fluid passage from said primary distribution tube to two of said plurality of adhesive application tubes, said plurality of adhesive application tubes being disposed on said base member in a preselected spacing.

2. The adhesive bead applicator of claim 1, wherein said adhesive dispensing means further includes at least two secondary adhesive distribution tubes disposed in fluid communication between said primary adhesive distribution tube and said plurality of adhesive application tubes.

3. The adhesive bead applicator of claim 2, wherein the plurality of adhesive application tubes includes four adhesive application tubes disposed on said base member, two of the four adhesive application tubes being disposed in fluid communication with one of said at least two secondary adhesive distribution tubes.

4. The adhesive bead applicator of claim 1, wherein said roofing substrate engaging means includes a pair of skid members disposed at opposing ends of said base member.

5. The adhesive bead applicator of claim 1, wherein said adhesive transfer assembly includes a manually operable valve selectively controlling said adhesive transfer assembly, said valve being capable of operation with one hand by an operator thereof.

6. The adhesive bead applicator of claim 1, further including fluid supply means containing a supply of adhesive urethane prepolymer adhesive, said adhesive supply means being disposed in fluid communication with said adhesive transfer assembly.

7. The adhesive bead applicator of claim 1, wherein said primary adhesive distribution tube and said plurality of adhesive application tubes have diameters that are the same.

8. The adhesive bead applicator of claim 1, wherein said plurality of adhesive application tubes have a diameter of between approximately one-half inch and approximately three-quarters inch.

9. A low-cost, hand-held apparatus for applying multiple streams of an adhesive to a roof substrate in a single pass, the apparatus comprising:

a handle member having a valve assembly mounted thereon, the valve assembly having an adhesive inlet and an adhesive outlet, a cross-member interconnected to the handle member and extending generally perpendicular thereto, the cross-member having means for positioning the cross-member a preselected distance from the roof substrate, multiple adhesive stream dispensing means including a primary adhesive distribution tube disposed on said handle member and extending between said nozzle assembly adhesive outlet and at least two secondary adhesive distribution tubes, the at least two secondary adhesive distribution tubes extending between said handle member and a plurality of adhesive application tubes disposed on said cross-member, said multiple adhesive stream dispensing means further including tube interconnection means including wye fittings interconnecting said primary adhesive distribution tube with said at least two secondary adhesive distribution tubes and further interconnecting said at least two secondary adhesive distribution tubes with said plurality of adhesive stream application tubes, said valve assembly outlet being adapted to receive an adhesive transfer tube extending from an adhesive supply source, said valve assembly further including a manually operated adhesive dispensing valve capable of operation with one hand, said adhesive stream application tubes having a diameter of between approximately one-half inch and three-quarters inch.

10. A low-cost, hand-held foam application rake for applying multiple beads of an adhesive in a preselected spacing to a generally planar substrate in a single pass, the rake comprising:

an elongated handle member having a valve assembly mounted thereon, the valve assembly having an inlet and an outlet, an elongated cross-member interconnected to the handle member and extending generally perpendicular thereto, the cross-member having means for positioning the cross-member a preselected distance from the substrate in operation, the positioning means including two skid members adapted to slidingly engage said substrate, the skid members being spaced apart and extending away from said cross-member, adhesive dispensing means providing a fluid passage between said valve assembly outlet and said cross-member, the adhesive dispensing means including a network of adhesive passage tubes, the network including a primary distribution tube and at least two secondary distribution tubes, the primary distribution tube being disposed on said handle member and extending between said valve assembly outlet and the at least two secondary distribution tubes, said secondary distribution tubes extending between said primary distribution tube and a plurality of adhesive application tubes disposed on said cross-member, said network of adhesive passage tubes including wye fittings interconnecting said primary distribution tube with said at least two secondary distribution tubes and interconnecting said at least two secondary distribution tubes with said plurality of adhesive application tubes, said valve assembly outlet being adapted to receive an adhesive transfer tube extending from an adhesive supply source, said valve assembly further including a manually operated adhesive dispensing valve capable of operation with one hand, said adhesive application tubes having a diameter of between approximately one-half inch and three-quarters inch.

11. A low cost, hand-held applicator for applying multiple beads, under pressure, of equal amounts of an adherent compound in a single pass onto a roofing substrate, the applicator comprising:

a base member, a handle member extending therefrom, the base member extending generally perpendicular to the handle member, said base member including means for slidably engaging the roofing substrate and maintaining said base member at a preselected distance from said roofing substrate;

a tubular network for dispensing the adherent compound multiple beads under pressure in equal amounts upon said roofing substrate, the tubular dispensing network being attached to said applicator and extending from said handle member to said base member, said tubular dispensing network including a primary distribution tube in fluid communication with multiple secondary distribution tubes, the multiple secondary distribution tubes being in fluid communication with multiple application tubes maintained proximate to said base member, each of said secondary distribution tubes being of substantially equal length to promote distribution of said equal amounts of said adherent compound multiple beads through said primary distribution tube to said multiple secondary distribution tubes and out of said multiple application tubes onto said roofing substrate, the apparatus receiving said adherent compound under pressure from a pressurized adherent compound supply source.

12. The applicator of claim 11 further including a manually operable valve selectively controlling flow of said adherent compound from said pressurized supply source into said primary distribution tube.

13. The applicator of claim 11, wherein said adherent compound supply source includes a supply of urethane prepolymer adhesive.

14. The applicator of claim 11, wherein said base member roofing substrate engagement means includes rollers disposed thereon.

15. The applicator of claim 11 wherein said primary distribution tube and said multiple secondary distribution tubes are interconnected together by a wye fitting and wherein said multiple secondary distribution and multiple application distribution tubes are interconnected together by wye fittings.

16. The applicator of claim 11, wherein said multiple application tubes have a diameter of between approximately one-half inch and approximately three-quarters inch.

17. bead applicator of claim 11, wherein said adherent compound is a general non-expanding, moistured-cured frothed urethane prepolymer.

18. A low-cost, hand-held adhesive foam application rake for applying multiple beads of an adhesive in a preselected spacing to a generally planar substrate in a single pass by depositing equal amounts of adhesive in adjacent multiple beads thereof, the rake comprising:

an elongated handle member having a connection assembly mounted thereon, the connection assembly having an inlet and an outlet;

an elongated cross-member interconnected to the handle member and extending generally perpendicular thereto, the cross-member further having means for positioning the cross-member away from the planar substrate a preselected distance in operation of said rake, the positioning means including two spaced apart members extending away from said cross-member and adapted to engage said substrate in a sliding manner;

adhesive dispensing means providing a fluid passage network between said connection assembly outlet and said cross-member, the fluid passage network including a plurality of interconnected adhesive passage tubes, the network including a primary adhesive distribution tube and at least two secondary adhesive distribution tubes in fluid communication with said primary adhesive distribution tube, each of said at least two secondary distribution tubes extending between said primary distribution tube and said cross-member, each of said at least two secondary distribution tubes being of substantially equal length to promote distribution of said equal amounts of said adhesive multiple beads onto said roofing surface, whereby each of said at least two secondary distribution tubes cooperates with said primary distribution tube to define fluid passages of equal length, the apparatus receiving said adhesive under pressure from a pressurized adhesive supply source.

19. The foam application rake of claim 18, further including a plurality of application tubes in fluid communication with said at least two secondary distribution tubes, pairs of said plurality of application tubes being interconnected to each of said at least two secondary distribution tubes, each of said plurality of application tubes being of substantially the same length and cooperating with said primary distribution tube and said at least two secondary distribution tubes to define multiple fluid passages extending between said connection assembly outlet and open ends of said plurality of application tubes which are of substantially equal length.

20. The foam application rake of claim 18, wherein said connection assembly includes a valve member capable of being operated with one hand.

* * * * *